United States Patent [19]

Kamota

[11] 4,214,527

[45] Jul. 29, 1980

[54] MOUNTING ARRANGEMENT FOR A PLATE CYLINDER AND FORM ROLLERS

[75] Inventor: Hiroyoshi Kamota, Kashiwa, Japan

[73] Assignee: Kormori Printing Machinery Co., Ltd., Tokyo, Japan

[21] Appl. No.: 672

[22] Filed: Jan. 3, 1979

[51] Int. Cl.[2] ..... B41F 31/34; B41F 13/14; B41F 13/28; B41L 27/36

[52] U.S. Cl. ..... 101/247; 101/248; 101/352

[58] Field of Search ..... 101/349, 350–352, 101/358, 362, 247, 218, 206–209, 182, 184, 185, 248

[56] References Cited

U.S. PATENT DOCUMENTS

| | | | |
|---|---|---|---|
| 1,060,624 | 5/1913 | Pearce et al. | 101/352 |
| 1,479,278 | 1/1924 | Blaine | 101/352 |
| 1,524,816 | 2/1925 | Dalby | 101/352 |
| 3,323,452 | 6/1967 | Pasquinelli | 101/352 X |
| 3,366,047 | 1/1968 | Hermach et al. | 101/216 |
| 3,538,849 | 11/1970 | Bohman | 101/352 |
| 3,691,956 | 9/1972 | James et al. | 101/352 X |
| 3,935,815 | 2/1976 | Keijer | 101/349 |

FOREIGN PATENT DOCUMENTS 1156370 6/1969 United Kingdom .

*Primary Examiner*—J. Reed Fisher
*Attorney, Agent, or Firm*—Stephen F. K. Yee

[57] ABSTRACT

The contact pressure and uniformity of the longitudinal contact between a plate cylinder and associated form rollers of a printing press can be adjusted at a single place by a cam arrangement. The cam arrangement also serves as throw-off mechanism for the form rollers. The uniformity is maintained substantially unaltered after subjecting the plate cylinder to a skewing adjustment.

4 Claims, 4 Drawing Figures

MOUNTING ARRANGEMENT FOR A PLATE CYLINDER AND FORM ROLLERS

BACKGROUND OF THE INVENTION

This invention relates generally to a printing press and more particularly to a mounting arrangement for a plate cylinder and associated form rollers.

In a web press or a sheet-fed press, the printing work is performed by applying ink from an ink fountain to a printing plate on a plate cylinder by means of ink form rollers through vibrating rollers and so forth, then transferring the ink onto the surface of a rubber blanket roller rotating in pressure contact with the plate cylinder, and further transferring the ink onto a web or sheet passing through the blanket roller. In such printing work, the contact pressure of the ink form rollers against the plate cylinder is an important factor and should be adjusted uniformly in the longitudinal direction with high accuracy.

FIG. 1 shows schematically the position of a plate cylinder in a conventional rotary press. Vibrating rollers 4 and a plate cylinder 1 are journalled in a pair of spaced frames and form rollers 3 are disposed in rolling contact with the plate cylinder 1 and the vibrating rollers 4. A supporting shaft 6 for each of the form rollers 3 is rotatably supported at either end by eccentric sleeves 5 received in bores of a pair of roller holders 2 which are swingably mounted on a shaft 7 of its associated vibrating roller 4. Thus, by rotating each eccentric sleeve 5, the distance between the axes of the respective form rollers 3 and the associated vibrating rollers 4 can be changed. An adjustable biasing means 8 is attached to each of the roller holders 2 for urging the form roller 3 in contact with the plate cylinder 1.

In this structure, control of the contact pressure of the respective form rollers 3 against the plate cylinder 1 is performed by first rotating the eccentric sleeves 5 to adjust the pressure between each form roller 3 and the vibrating roller 4, and then operating the biasing means 8 to adjust the pressure between the form roller 3 and the plate cylinder 1. The pressure adjustment in such conventional arrangement is, however, very difficult to make and requires much time because the adjusting operation has to be performed manually among multiple rollers.

For precise registration of impressions, skewing adjustment of the plate cylinder is often conducted. To achieve this purpose, one end of the plate cylinder is supported by an eccentric sleeve rotatably mounted in the frame. A rod is connected to the eccentric sleeve and the skewing adjustment is executed by rotating the eccentric sleeve by means of the rod. Smooth adjustment of the rod becomes, however, difficult where the plate cylinder is arranged to be displaced axially for lateral adjustment. Moreover, with the arrangement shown in FIG. 1, the uniformity of the contact pressure between respective form rollers and the plate cylinder is lost after the skewing adjustment.

For interrupting application of the ink onto the printing plate, a roller throw-off mechanism is used. For example, in the arrangement shown in FIG. 1, the throw-off is achieved by rotating an arm 9 by an air cylinder (not shown) in the direction of the arrow so as to separate the form rollers 3 from the plate cylinder 1 by way of a cam 10, a cam lever 11, a connecting rod 12 and a roller lift lever 13. With respect to the purpose of changing the distance between the axes of the form roller 3 and the plate cylinder 1, both the roller lifting action and the contact pressure adjustment can be regarded as the same, and therefore it is desirable that these two actions are performed by a single mechanism.

BRIEF SUMMARY OF THE INVENTION

It is, therefore, an object of the present invention to provide an improved mounting arrangement for a plate cylinder and associated form rollers in a printing press, which is devoid of the problems involved in the conventional arrangement.

Another object of this invention is to provide a mounting arrangement for a plate cylinder and associated form rollers, which allows the adjustment of contact pressure between respective rollers to be made from a single place.

A further object of this invention is to provide a simple and easy to handle mechanism capable of throw-off of all form rollers by a single operation.

BRIEF DESCRIPTION OF THE DRAWINGS

Other objects, features and advantages of this invention will become apparent from the detailed description of the preferred embodiment which follows, when considered in light of the accompanying drawings, in which.

DETAILED DESCRIPTION OF THE PREFERRED EMBODIMENTS OF THE INVENTION

Figure 3:
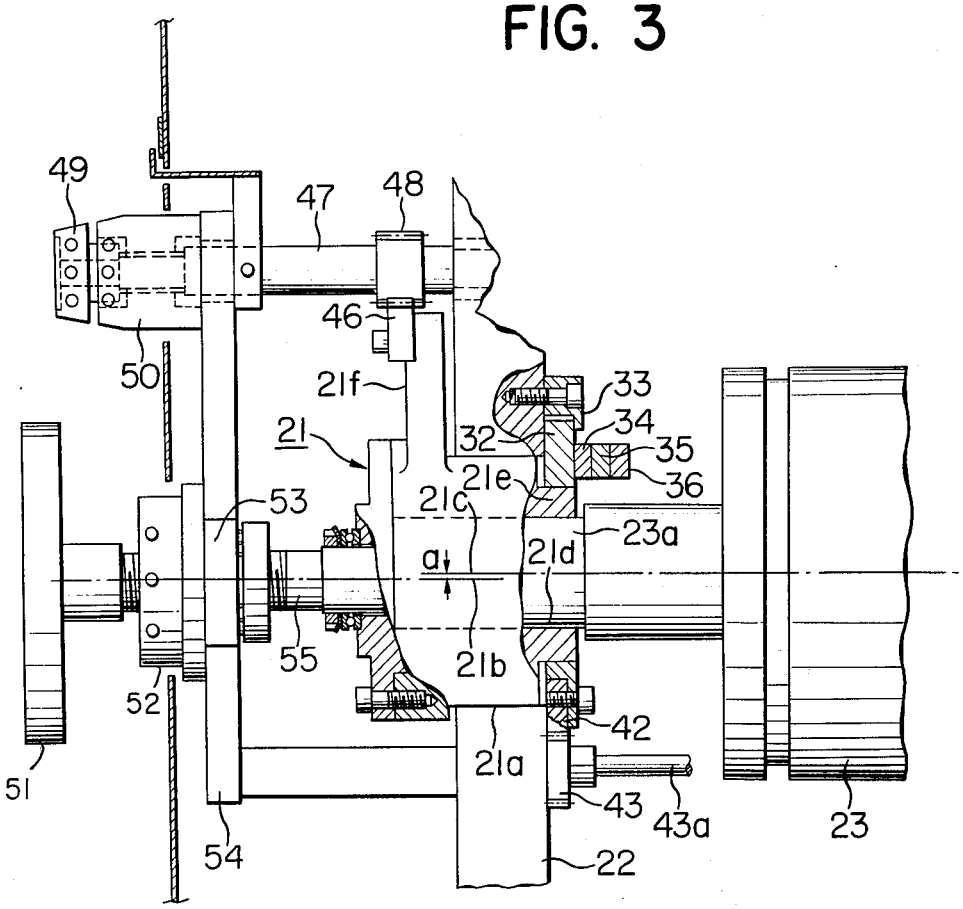
FIG. 3 is a fragmentary plan view, partially in cross section, showing diagrammatically a supporting mechanism for the plate cylinder of FIG. 2.

Referring first to FIG. 3, a plate cylinder 23 on the outer peripheral surface of which a printing plate (not shown) is mounted, is journalled in a pair of spaced frames 22. Labeled generally as 21 is a supporting member having a sleeve portion whose outer surface **21*a* is rotatably supported by one of the frames 22. The supporting member 21 has a shaft hole 21*d* whose axis 21*c* deviates by a eccentrically from an axis 21*b* of the outer surface 21*a* thereof. A shaft 23*a* of the plate cylinder is rotatably mounted at one end in the shaft hole 21*d*. The other end (not shown) of the shaft 23*a*** is supported in a sleeve, preferably an eccentric sleeve of the same type as above.

Figure 1:
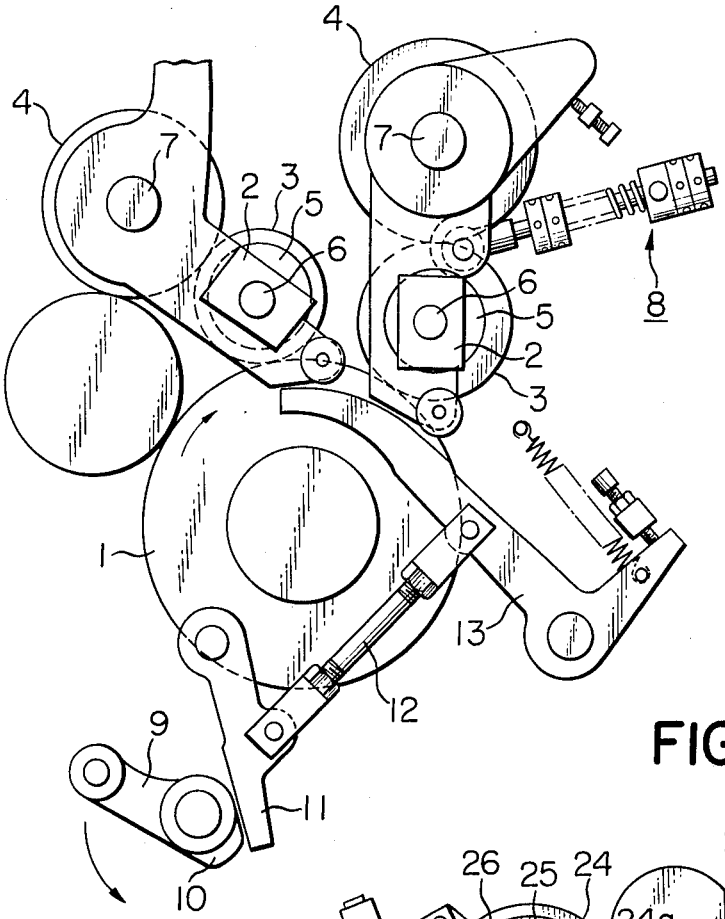
FIG. 1 PRIOR ART
FIG. 1 is a side elevational view diagrammatically showing a conventional arrangement in a printing press.
Figure 2:
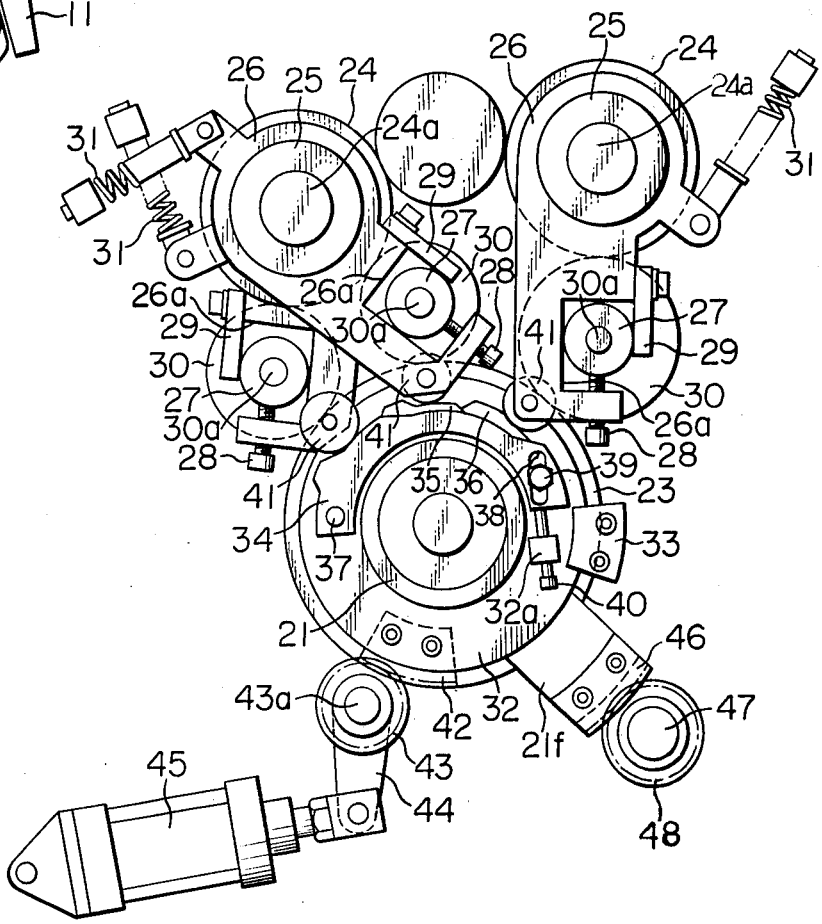
FIG. 2 is a side elevational view diagrammatically showing the position of a plate cylinder in a printing press of the present invention.
Figure 4:
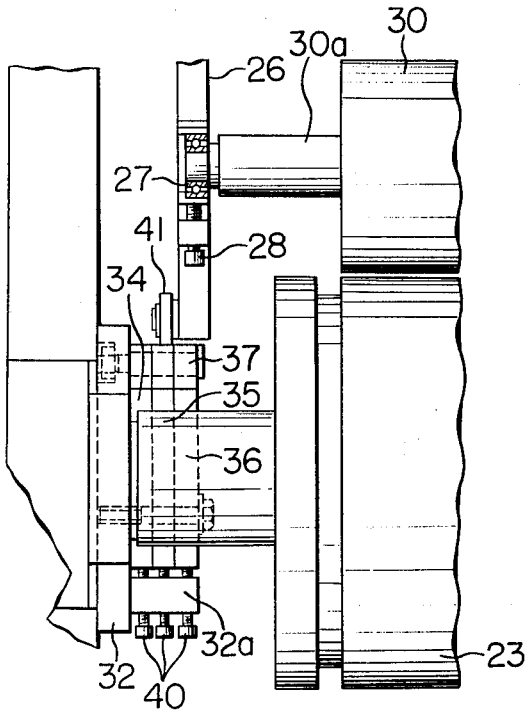
FIG. 4 is a fragmentary plan view, partially in cross section, diagrammatically showing the relationship of a form roller to the plate cylinder of FIG. 2 .

Referring to FIG. 2, vibrating rollers 24 are radially disposed above the plate cylinder 23 and are rotatably mounted at both ends thereof in bushings 25 received in the opposite frames 22. On both end portions of a shaft **24*a* of each of the vibrating rollers 24 are swingably mounted a pair of roller holders 26, each of which is provided, at a lower U shaped portion 26*a* thereof, with a bearing 27 in which a shaft 30*a* of respective form rollers 30 is rotatably supported. Each bearing 27 is locked by a cover 29 so as to be prevented from slipping off from the depressed portion 26*a*. As shown in FIG. 4, each bearing 27 is movable up and down by turning an adjustable bolt 28 in either direction. Thus, the contact pressure of each form roller 30 on its associated vibrating roller 24 can be adjusted uniformly by sliding each bearing 27 by means of the bolt 28**.

Each form roller 30 is also disposed in contact with the plate cylinder 23. As shown in FIG. 2, a compression helical spring 31 is attached to each roller holder 26 for applying a rotary force thereto in the direction to press the form roller 30 against the plate cylinder 23. The contact pressure between the plate cylinder 23 and respective form rollers 30 can be uniformly adjusted in the arrangement of the present invention as described hereinbelow.

Referring again to FIG. 3, the supporting member 21 has a small-diameter stepped portion 21*e* whose outer periphery is formed to be concentric with the shaft hole 21*d*, and an annular cam base 32 is mounted rotatably on the stepped portion 21*e*. The axial motion of the cam base 32 is regulated by a guide 33 screwed to the frame 22. Cams 34, 35 and 36, equal in number to the number of the form rollers 30, are attached on the cam base 32 such that an arcuate root of each cam can be in concentrical relationship with the shaft hole 21*d*. As shown in FIG. 2, each cam is generally shaped to be arcuate or semicircular and its circumferential cam surface is composed of arcuate root, crest and inclined surface formed therebetween, with which a roller 41 provided at the fore end of each roller holder 26 is rolling contact. During printing operation, the rollers 41 are engaged with the roots of the cams.

The cams 34, 35 and 36 are superposed on one another and are supported by a common pivot 37 at each one end thereof. A slot 38 is formed at the other end of each of the cams, in which a bolt 39 is inserted for fixing them integrally to the cam base 32. The cam base 32 has a protruded portion 32*a* having internally threaded openings, equal in number to the number of the cams, with which adjusting screws 40 are engaged. The edge of each of the screws 40 is engageable by the cam surface of respective one of the cams.

Substantially the same cam arrangement is provided in the sleeve in the other side of the plate cylinder. Thus, when the bolts 39 are loosened, the cams are separately swingable about the pivots 37 by turning the screws 40. As a consequence, circumferential cam surfaces are moved upward or downward to cause vertical motion of the rollers 41 of the roller holders 26, enabling desirable contact pressure and uniform longitudinal contact to be obained between the plate cylinder 23 and respective form rollers. After adjusting the pressure between the each form roller 30 and the plate cylinder 23, the bolts 39 are tightly fastened. It is preferred that the arcuate root of each cam is substantially concentric with the shaft hole 21*d* so that the uniformity is maintained even when the axis of the plate cylinder is skewed by the rotation of the supporting member 21. Though the concentricity is slightly affected upon the pressure adjustment by means of the screws 40, this has been found to have little actual influence on the uniformity.

As seen in FIG. 2, a segment gear 42 is screwed to each cam base 32 at the lower end of its circumferential surface and is engaged with a pinion 43 rotatably supported on the frame 22. The pinions 43 on both frames 22 are fixedly interconnected by a shaft 43*a* on which a lever 44 is rigidly mounted at one end. The other end of the lever 44 is pivoted at the fore end of an air cylinder 45, of which expansion or contraction causes the lever 44 to swing, which in turn causes the pinions 43 to rotate. Consequently, the cam bases 32 are rotated simultanteously with the segment gears 42 being in engagement with the pinions 43. In the state as shown in FIG. 2, if the cam base is rotated clockwise by swinging the lever counterclockwise about the shaft 43*a*, all three rollers 41 will be positioned at the crests of the cams 34, 35 and 36 respectively so that the form rollers 30 may be separated simultaneously from the plate cylinder 23 to execute the throw-off. When the cylinder is actuated to be turned to the original state, the form rollers 30 can be restored to the original relationship with the plate cylinder 23. Thus, throw-off and returning of all form rollers can be done by a single cylinder 45.

The axis of the plate cylinder can be skewed as follows. As shown in FIG. 3, the supporting member 21 has an arm 21*f* to which a segment gear 46 is screwed. The segment gear 46 is kept in engagement with a pinion 48 secured on a gear shaft 47 rotatably supported at the rear end on the frame 22. The fore end of the gear shaft 47 is equipped with a handle 49 for rotation of the shaft 47 and also with a lock handle 50 for locking the handle 49 after rotating the same. When the supporting member 21 is rotated by the handle 49 through the pinion 48 and the segment gear 46, the axis 21*c* of the plate cylinder 23 can be shifted. It is important that the gear 46 be slidable relative to the pinion 48 while keeping their engagement in order to allow the lateral adjustment of the plate cylinder.

Referring continuously to FIG. 3, labeled as 51 is a lateral adjustment handle for displacing the plate cylinder 23 in the axial direction.

Internal screw threads on a portion 53 of a mounting plate 54 secured to the frame 22 engage screw threads on a rotatable shaft 55 to which the handle 51 is mounted at one end. The other end of the shaft 55 is rotatably connected to the supporting member 21. A lock handle 52 is provided for locking the handle 51. When the shaft 55 is rotated by turning the handle 51, the shaft 55 is caused to move in opposite directions, which in turn causes the supporting member 21 to be moved in opposite directions. This motion serves to shift the plate cylinder whose shaft 23*a* is captive in the supporting member 21.

The contact pressure among the rollers is controlled as follows. First, each bolt 28 is shifted forward or backward to adjust the contact pressure between the vibrating roller 24 and the associated form roller 30. After loosening the bolt 39, the cams 34, 35 and 36 are adjusted individually by each screw 40 to control the contact pressure between each form roller 30 and the plate cylinder 23. To obtain a precise registration, the supporting member 21 is rotated by operating the handle 49 so as to move the plate cylinder 23, upward or downward for skewing adjustment. Further, if necessary the plate cylinder 23 is shifted in the axial direction by rotation of the adjustment handle 51 after loosening the handle 52. Although the directions of the movement of the plate cylinder by the skewing adjustment and by the lateral adjustment are orthogonal with each other, smooth actions are ensured as the pinion 48 is shaped to be sufficiently wide.

As is obvious from the above description, the contact pressure between form rollers and a plate cylinder is adjusted by adjusting the level of the circumferential cam surfaces of semicircular cams. All of these cams can be rotated together by a gear mechanism to separate a plurality of form rollers simultaneously from the plate cylinder, so that it becomes possible to group the pressure control mechanisms in one region for the form rollers and to install them in a space where the rollers and other components are not present, hence offering remarkable operational convenience. Moreover, such pressure control mechanisms are usable for lifting the rollers for the interruption of the printing work, thereby reducing the number of required components to simplify the structure. The skewing operation is easily made by an external handle located outside of the frame. Additionally, the two actions of the cylinder skewing adjustment and the lateral adjustment do not affect each other to attain extremely smooth operation as a result.

The invention may be embodied in other specific forms without departing from the spirit or essential characteristics thereof. The present embodiments are therefore to be considered in all respects as illusrative and not restrictive, the scope of the invention being indicated by the appended claims rather than by the foregoing description, and all changes which come within the meaning and range of equivalency of the claims are therefore intended to be embraced therein.

What is claimed is:

1. A printing press comprising:

a pair of spaced frames;

a supporting member having a portion whose outer surface is rotatably supported by one of said frames and being provided with a shaft hole formed eccentrically with respect to said outer surface;

a plate cylinder having a concentric shaft rotatably supported at one end in the shaft hole of said supporting member and the other end in a sleeve secured to the other frame;

means for rotating said supporting member so that the axis of said plate cylinder may be skewed;

vibrating rollers journalled in the frames;

form rollers engageable with said plate cylinder and said vibrating rollers;

pairs of roller holders swingably mounted around both end portions of said vibrating rollers, each of said form rollers being journalled in respective one of said pairs of roller holders;

means attached to each of said roller holders for urging said roller holder in the direction to press its form roller against said plate cylinder;

a pair of cam bases one of which is rotatably supported by said supporting member and the other is rotatably supported by said sleeve, said cam bases being operatively connected with each other;

arcuate cams provided on each cam base, rotatable therewith and equal in number to the number of said form rollers, each of said cams being swingably supported at one end to said cam base, having a cam surface adapted to be engaged with a portion of respective one of said roller holders and being adjustably fixed at the other end to said cam base, each of said cam surfaces including a crest and an arcuate root with which said portion of each roller holder is engaged during printing operation; and means for simultaneously rotating said pair of cam bases so that said portion of each of said roller holders is engaged by said crest of respective one of said cams, whereby said form rollers are simultaneously thrown-off from said plate cylinder.

2. A printing press as claimed in claim 1, wherein each of said cams in each cam base are swingably supported at one end by a common pivot on said cam base and is provided with a slot at the other end; said slot being internally engageable by a common bolt for integrally fixing said cams to said cam base.

3. A printing press as claimed in claim 2, wherein each cam base has a protruded portion provided internally with threaded openings equal in number to the number of said form rollers and with which screws are engaged, the edge of each of said screws being engageable with the end edge of respective one of said cams for adjustably positioning same.

4. A printing press as claimed in claim 1, further comprising means for displacing said supporting member in the axial direction for effecting a lateral adjustment of the plate cylinder.

* * * * *